US011591530B2

(12) United States Patent
Pradeep et al.

(10) Patent No.: US 11,591,530 B2
(45) Date of Patent: Feb. 28, 2023

(54) ADDITIVE FOR PREVENTING FOULING OF THERMAL CRACKER FURNACE

(71) Applicant: INDIAN OIL CORPORATION LIMITED, Maharashtra (IN)

(72) Inventors: Ponoly Ramachandran Pradeep, Faridabad (IN); Prantik Mondal, Faridabad (IN); Shahil Siddiqui, Faridabad (IN); Ramu Emmandi, Faridabad (IN); Satyen Kumar Das, Faridabad (IN); Madhusudan Sau, Faridabad (IN); Gurpreet Singh Kapur, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 17/711,308

(22) Filed: Apr. 1, 2022

(65) Prior Publication Data

US 2022/0315849 A1 Oct. 6, 2022

(30) Foreign Application Priority Data

Apr. 2, 2021 (IN) ..... 20212101577.1

(51) Int. Cl.
*C10G 75/04* (2006.01)
*C10G 9/00* (2006.01)

(52) U.S. Cl.
CPC ..... *C10G 75/04* (2013.01); *C10G 9/00* (2013.01); *C10G 2300/202* (2013.01); *C10G 2300/206* (2013.01); *C10G 2300/308* (2013.01); *C10G 2300/4075* (2013.01)

(58) Field of Classification Search
CPC ..... C10G 75/04
See application file for complete search history.

(56) References Cited

U.S. PATENT DOCUMENTS

| | | | | |
|---|---|---|---|---|
| 4,378,288 | A | 3/1983 | Shih et al. | |
| 5,039,391 | A | 8/1991 | Reid et al. | |
| 2009/0211947 | A1* | 8/2009 | Stark | C10G 75/04 208/48 AA |
| 2009/0266742 | A1* | 10/2009 | Newman | C10G 9/16 208/131 |
| 2010/0038289 | A1* | 2/2010 | Wang | C10L 1/10 422/198 |
| 2010/0147739 | A1* | 6/2010 | Levine | C10G 75/04 196/46 |
| 2011/0042268 | A1 | 2/2011 | Stark et al. | |

FOREIGN PATENT DOCUMENTS

| | | | | |
|---|---|---|---|---|
| JP | H11323208 | A | 11/1999 | |
| WO | WO-2015199797 | A1 * | 12/2015 | B01J 19/008 |

* cited by examiner

*Primary Examiner* — Randy Boyer
*Assistant Examiner* — Juan C Valencia
(74) *Attorney, Agent, or Firm* — Maschoff Brennan

(57) ABSTRACT

The furnace of a delayed coking unit which is utilized for heating residue feeds to high temperatures can suffer from decrease in run length and fouling caused by caustic carry-over from the upstream desalter unit. An antifoulant additive for preventing caustic induced fouling of thermal cracker furnace tubes is disclosed. The described antifoulant additive acts by converting the inorganic caustic compound such as NaOH to naphthenate salt of the metal as well as by reducing the fouling tendency of the whole feedstock, thereby making it ineffective in causing coking reaction. The additive finds application in thermal residue upgradation furnaces such as delayed coking unit, visbreaker, etc.

15 Claims, No Drawings

ADDITIVE FOR PREVENTING FOULING OF THERMAL CRACKER FURNACE

FIELD OF THE INVENTION

The furnace of a delayed coking unit which is utilized for heating residue feeds to high temperatures can suffer from decrease in run length and fouling caused by caustic carryover from the upstream desalter unit. An antifoulant additive for preventing caustic induced fouling of thermal cracker furnace tubes is disclosed.

BACKGROUND OF THE INVENTION

Furnace run length plays critical role in sustainable operation of delayed coking unit. Furnace is considered as the heart of the thermal cracker units such as delayed coking unit and visbreaking unit, which is used to supply necessary heat for thermal cracking reactions to occur. It is the most critical hardware in the unit and slight coking inside coils and consequent increase in pressure drop can hamper the unit operation. Fouling of furnace tubes and shorter run lengths lead to unscheduled shutdowns of the unit which affect the profitability of the whole refinery. This decrease in the furnace run length is not economical for any refiner. One particular operational issue faced by refiners is the carryover of caustic compounds dosed in the desalter unit into the crude oil, which particularly gets concentrated in the vacuum residue fraction of the crude oil. This caustic content in the vacuum residue when reaches the furnace of the delayed coker unit, it speeds up the coking reactions including dehydrogenation reactions causing faster rates of fouling of furnace tubes. This situation demands the refiner to reduce the operational severity of the delayed coker unit by means of reduction in throughput, furnace outlet temperature etc. which causes deterioration in product yield pattern and refinery profitability. The literature is replete with various means employed to decrease fouling in a wide variety of hydrocarbon processes.

U.S. Pat. No. 4,378,288 describes about using a mixture of hydroquinone and n-phenyl-2-naphthylamine along with the feedstock at dosing rates of 0.005 to 10 wt % to reduce the coking tendency in Delayed Coker Unit.

U.S. Pat. No. 5,039,391 claims use of boron containing compounds such as ammonium borate and dihydroxybenzenes for reducing furnace tube fouling tendency of delayed coker unit. Dosing of antifoulant in the range of 1 to 600 ppmw is proposed in the said prior art for causing reduction of furnace tube fouling.

US 2011/0042268 describes the use of a combination of sulfurized oil, magnesium/aluminium overbases and alpha olefin copolymers for reducing the coker furnace tube fouling. The sulfurized oil used in this prior art include sulfurized polyolefins.

JPH11323208A refers to an antifouling paint for coating a ship or underwater structure, a ship outer panel or an underwater structure and containing (a) a hydroxy metal (meth) acrylate copolymer, (b) a metal salt of a carboxylic acid, and (c) copper and/or a copper compound. The metal salt of a carboxylic acid (b) is at least one selected from a metal salt of a naphthenic acid, a metal salt of a rosin-based resin, and a metal salt of a fatty acid.

In the prior arts referred above, the compounds which are used for reducing the furnace tube fouling are arresting the deposition of coke on the metallic surface by reducing the asphaltene precipitation mechanism by stabilizing the asphaltenes as well as by removing the free radicals. Therefore, there is a need for an antifoulant additive that acts by metal passivation as well as by reducing the fouling tendency of whole feedstock, thereby making it ineffective in causing coking reaction. This will primarily be beneficial in preventing caustic induced furnace fouling phenomena, a solution which is not provided by the prior arts in the field.

OBJECTIVE OF THE INVENTION

The primary objective of the disclosure is to caustic induced fouling of the furnace of a delayed coker unit.

An objective of the disclosure is to prevent fouling of furnace tubes caused by caustic carryover to residue feedstock, without the need for reducing the operational severity of a delayed coker unit.

Another objective of the disclosure is to provide an antifoulant additive to prevent caustic induced furnace fouling by neutralizing and converting the caustic compound to a benign naphthenate form as well as to reduce the fouling tendency of whole feedstock.

SUMMARY OF THE INVENTION

The additive comprising naphthenic acid, petroleum sulphonate, phosphate ester and gasoil provides an effective remedy for caustic induced furnace fouling by neutralizing and converting the caustic compound to naphthenate form as well as by reducing the fouling tendency of the whole residue feedstock. The additive to is also used to prevent fouling of furnace tubes caused by caustic carryover to residue feedstock, without the need for reducing the operational severity of a thermal cracking unit, particularly a delayed coker unit.

In one aspect, an antifoulant additive for preventing caustic induced furnace fouling comprises:

(a) naphthenic acid, (b) petroleum sulphonate, (c) phosphate ester, and (d) gasoil.

In another aspect, the naphthenic acid has a molecular weight in the range of 160 to 350 g/gmol and carbon number in the range of 8 to 25.

In yet another aspect, wherein the carbon atoms of the naphthenic acid ranges from 8 to 25.

In a preferred aspect, the naphthenic acid is 3-Methyl-1-cyclohexanecarboxylic acid.

In a further aspect, the petroleum sulphonate is calcium petroleum sulphonate having TBN in the range of 30 to 100.

In yet another preferred aspect, the phosphate ester is a trialkyl or triaryl phosphate.

In another aspect, the gasoil is a light coker gasoil or heavy coker gasoil stream boiling in the range of 140-540° C.

In an aspect, the naphthenic acid is present in the range of 50 to 95% by weight of the total additive.

In another aspect, the petroleum sulphonate is present in the range of 0.1 to 20% by weight of the total additive.

In a further aspect, the phosphate ester is present in the range of 0.2 to 15% by weight of the total additive.

In one aspect, the gasoil is present in the range of 1 to 30% by weight of the total additive.

In a preferred aspect, a process for preparation of an antifoulant additive for preventing caustic induced furnace fouling comprises:

a) adding naphthenic acid in a continuous stirred tank reactor at 30-50° C.;

b) adding petroleum sulphonate and phosphate ester to the reactor of step a) while stirring to obtain a mixture;

c) adding gasoil stream to the mixture of step b) and stirring for 20 minutes; and d) cooling the above mixture to room temperature to obtain the antifoulant additive.

In yet another preferred aspect, the naphthenic acid is added to the reactor at 40° C.

In another aspect, a process for preventing caustic induced furnace fouling comprises adding the antifoulant additive to a thermal cracker unit processing residue feedstock having CCR in the range of 3 to 32 wt %.

In yet another aspect, the additive is injected in feed surge drum or fractionator bottom section or furnace charge pump outlet of a thermal cracking unit.

In an aspect, the additive is injected at a rate of 1 to 1000 ppm in the feedstock to a thermal cracking unit.

DETAILED DESCRIPTION OF THE INVENTION

Those skilled in the art will be aware that the present disclosure is subject to variations and modifications other than those specifically described. It is to be understood that the present disclosure includes all such variations and modifications. The disclosure also includes all such steps of the process, features of the product, referred to or indicated in this specification, individually or collectively, and any and all combinations of any or more of such steps or features. The present disclosure is not to be limited in scope by the specific embodiments described herein, which are intended for the purposes of exemplification only. Functionally-equivalent products and methods are clearly within the scope of the disclosure, as described herein.

In delayed coking process, vacuum residue (bottoms from vacuum distillation unit) is subjected to severe thermal cracking where the necessary heat is supplied by the furnace. Therefore, coker furnace is considered as heart of the delayed coking unit. It is the most critical hardware in the unit, sudden outage of furnace will lead to shut down of the whole unit.

Feedstock:

In one embodiment, the feedstock is selected from residue streams such as vacuum residue, atmospheric residue, Solvent Deasphalting (SDA) pitch, ethylene tar, coal tar pitch, clarified oil having a density of more than 0.9 g/cc and Conradson Carbon Residue (CCR) content in the range of 3 to 32 wt %. Feeds such as vacuum residue are highly prone to coking inside the coils due to high asphaltene content as well as other high molecular weight compounds. Further, the fouling of furnace tubes increases due to increased contents of caustic such as NaOH in the feedstock the furnace which comes due to carryover from the desalter unit. The caustic compounds enhance the dehydrogenation reactions by removing the hydrogen from the hydrocarbon chains and cause formation of coke precursors. Coking inside the coils increase the pressure drop affecting the heat transfer between the flue gas and process fluid which further necessitates more heat requirement. Further, this increase in fouling results in untimely shutdown of the coker furnace.

Antifoulant Additive:

The present invention provides an antifoulant additive comprising:

i. a Naphthenic acid, ii. a petroleum sulphonate, iii. a phosphate ester, and iv. a gasoil.

In an embodiment of the present invention, the naphthenic acids are carboxylic acids with single or multiple saturated ring structures, including aromatic carboxylic acids. Naphthenic acids are mainly cyclopentane, cyclohexane or polycyclic derivatives. They have unsaturated bonds, aromatic rings, or hydroxyl groups. In a preferred embodiment, the naphthenic acid is 3-Methyl-1-cyclohexanecarboxylic acid. Naphthenic acid reacts with the caustic compound to form corresponding naphthenate compound.

In another embodiment of the present invention, the petroleum sulphonate is calcium petroleum sulphonate having TBN in the range of 30 to 100.

In yet another embodiment, the phosphate ester is selected from trialkyl or triaryl phosphates. In a preferred embodiment, the phosphate ester is trimethyl phosphate.

In a further embodiment, the gasoil is a light coker gasoil or heavy coker gasoil stream boiling in the range of 140-540° C. The gas oil is added as a diluent in the additive to ensure flowability.

The antifouling agents of the disclosure is used in amounts effective to stop or mitigate fouling. The amount that is necessary will be, to some extent, dependent upon the properties of the hydrocarbon feed in which it will be used. The dosing is decided further based on the amount of caustic carryover in the residue feedstock and the molecular weight of the additive employed. In most cases, the hydrocarbon feed will be a very heavy hydrocarbon feed with a significant tendency to produce fouling. The additive is injected in different locations such as the feed surge drum, fresh feed pump outlet, main fractionator bottom or furnace charge pump outlet. The additive is preferably injected in the feed surge drum in order to provide sufficient residence time to enable reaction between the antifoulant additive and the caustic compound. Therefore, the additive disclosed provides an effective remedy to refiners in the situation of caustic induced furnace fouling by neutralizing and converting the caustic compound to naphthenate form as well as to prevent fouling tendency of the feedstock entering the furnace.

In a preferred embodiment, the naphthenic acid is present in the range of 50 to 95% by weight of the total additive.

In another preferred embodiment, the petroleum sulphonate is present in the range of 0.1 to 20% by weight of the total additive.

In yet another embodiment, the phosphate ester is present in the range of 0.2 to 15% by weight of the total additive.

In a further embodiment, the gasoil is present in the range of 1 to 30% by weight of the total additive.

In an embodiment, the naphthenic acid has a molecular weight in the range of 160 to 350 g/gmol and carbon number in the range of 8 to 25.

In one embodiment, the carbon atoms of the naphthenic acid ranges from 8 to 25.

In one embodiment, the disclosure provides a process for preparation of an antifoulant additive for preventing caustic induced furnace fouling, the process comprising:

a) adding naphthenic acid in a continuous stirred tank reactor at 30-50° C.;

b) adding petroleum sulphonate and phosphate ester to the reactor of step a) while stirring to obtain a mixture;

c) adding gasoil stream to the mixture of step b) and stirring for 20 minutes; and d) cooling the above mixture to room temperature to obtain the antifoulant additive.

In another embodiment, the naphthenic acid is added to the reactor at 40° C.

In another embodiment, the disclosure provides a process for preventing caustic induced furnace fouling, the process comprising adding the antifoulant additive to a thermal cracker unit processing naphtha or gasoil along with a feedstock.

In yet another embodiment, the additive is injected in a feed surge drum of a thermal cracking unit.

In a preferred embodiment, the additive is injected at a rate of 1 to 1000 ppm in the feedstock of a thermal cracking unit.

Process Conditions:

In an embodiment, the additive of the present invention is supplied to the hydrocarbon liquid feed at locations consisting of feed surge drum at temperature ranging from 85 to 200° C., main fractionator bottom section at temperature ranging from 250 to 380° C. and a thermal cracker furnace. The temperature inside the thermal cracker furnace ranges from 300 to 520° C. while the pressure of the furnace ranges from 3 at outlet to 60 kg/cm$^2$ g at inlet.

Advantages of the Antifoulant Additive:

The following are the technical advantages of the disclosed antifoulant additive over the conventional additives:

- The additive disclosed addresses the issue of caustic induced furnace fouling by neutralizing the caustic compound by converting the same to benign naphthenate form.
- The additive disclosed helps to maintain the operational severity of the delayed coking furnace by preventing fouling.
- There are no impacts on the product yields or quality while use.
- The reaction between the antifoulant additive and the caustic compound is completed within the time of injection in the feed surge drum of the delayed coker unit and when it reaches the coker furnace for heating.

EXAMPLES

The disclosure will now be illustrated with working examples, which is intended to illustrate the working of disclosure and not intended to take restrictively to imply any limitations on the scope of the present disclosure. Unless defined otherwise, all technical and scientific terms used herein have the same meaning as commonly understood to one of ordinary skill in the art to which this disclosure belongs. Although methods and materials similar or equivalent to those described herein can be used in the practice of the disclosed methods, the exemplary methods, devices and materials are described herein. It is to be understood that this disclosure is not limited to particular methods, and experimental conditions described, as such methods and conditions may vary.

Example 1

Four antifoulant additives comprising different concentrations of naphthenic acid, petroleum sulphonate, phosphate ester and gasoil were prepared using the process comprising:

a) adding naphthenic acid in a continuous stirred tank reactor at 40° C.;
b) adding petroleum sulphonate and phosphate ester to the reactor of step a) while stirring to obtain a mixture;
c) adding gasoil stream to the mixture of step b) and stirring for 20 minutes; and
d) cooling the above mixture to room temperature to obtain the antifoulant additive.

The four additives prepared using the process above are provided in Table 1 along with their specific concentrations.

TABLE 1

Additives prepared for the experiments

| Additive Components | Claimed range | A | B | C | D |
|---|---|---|---|---|---|
| Naphthenic acid, wt % | 50-95 | 85 | 48 | 85 | 78 |
| Petroleum sulphonate, wt % | 0.1-20 | 5 | 20 | 0.05 | 1 |
| Phosphate Ester, wt % | 0.2-15 | 7 | 15 | 10 | 20 |
| Gasoil, wt % | 1-30 | 3 | 17 | 4.95 | 1 |

The properties of the reduced crude oil (RCO) sample arranged from one of the Indian Refineries for conducting the experimental study are provided in Table 2.

TABLE 2

Properties of Reduced Crude Oil (RCO) sample

| Parameter | Value |
|---|---|
| Density, Kg/m$^3$ | 973 |
| CCR, wt % | 10.1 |
| Sulfur, wt % | 3.65 |
| Nitrogen, wt % | 1.5 |
| Asphaltenes, wt % | 5.1 |
| ASTM D2887 distillation (wt % vs° C.) | |
| 5 | 192 |
| 10 | 311 |
| 30 | 405 |
| 50 | 463 |
| 70 | 542 |
| Metal, ppmw | |
| Ca | 1 |
| Fe | 3 |
| Mg | <1 |
| Na | 21 |
| Ni | 40 |
| V | 77 |

Experiments were carried out using the heavy residue hydrocarbon feedstock to check differences in the coke deposit tendency with respect to the usage of additives as provided in Table 1.

Experimental Procedure to Assess Coke Deposition in Furnace Tubes and Impact of Additives on Coke Deposition:

For simulating the hot liquid passing on the metal surface, as in the case of a furnace tube, an autoclave set up was employed with a metallic piece made of stainless steel (SS-316) of 1"×0.5" size fitted on to the tip of a stirrer. The procedure employed for the experiment included heating of the residue feedstock loaded into the autoclave at the desired temperature and stirring the same using the stirrer fitted with the metallic piece, for a definite period of time at set rpm. After the completion of the stirring period, the metallic piece on which the coke is deposited, is taken out, washed in toluene to remove the residual hydrocarbons, dried and weighed. The coke deposited is measured by deducting the total weight of metallic plate with coke deposit from the initial weight of clean plate. The impact of use of the antifoulant additives is deduced by comparing the coke deposits with the coke deposit in the base case.

The operating conditions maintained during the experiments are provided in Table 3.

TABLE 3

Operating conditions of experiments

| Parameter | Value |
|---|---|
| Temperature, ° C. | 370 |
| Pressure, Kg/cm$^2$g | Autogenous |
| Residence time, hours | 1 |
| Stirring speed, rpm | 500 |

The residue feed (Reduced Crude Oil) was used as neat feedstock for the base case experiment number 1. Further, experiment number 2 was conducted using RCO doped with caustic (NaOH). Additionally, four more experiments (numbered 3, 4, 5 and 6) were conducted using 100 ppm of each of the additives A, B, C and D respectively. The results of the fouling experiments are provided in Table 4.

TABLE 4

Fouling experiment results

| Experiment No. | 1 | 2 | 3 | 4 | 5 | 6 |
|---|---|---|---|---|---|---|
| Feed | RCO | RCO | RCO | RCO | RCO | RCO |
| NAOH, ppm | — | 100 | 100 | 100 | 100 | 100 |
| Additive, ppm | — | — | 100 | 100 | 100 | 100 |
| Additive used | — | — | A | B | C | D |
| Coke Deposit, mg | 80 | 150 | 86 | 126 | 115 | 109 |

The results of Table 4 indicate that there is an increase in deposit formation with presence of concentration of the caustic compound in the residue feedstock. It is also observed that the additive dosed into the caustic spiked residue feedstock interacted with the caustic, inhibiting the coke deposit formation of the metallic piece. Further, additive A (having a composition within the claimed ranges of each claimed component) resulted in maximum reduction in coke deposition on the plate for the residue feedstock.

Example 2

In the second set of experiments, the residue feedstock 'reduced crude oil' (RCO) as provided in Table 2 was used as the feedstock. Caustic (NaOH) was dopped at a level of 100 ppm in the feedstock to simulate the caustic carryover situation in refinery. Experiments were carried out at different temperatures and reaction times as shown in Table 5 to determine the reactivity between caustic and antifoulant Additive-A of Table 1. Conversion of sodium hydroxide to sodium naphthenate after each experiment was determined by using FTIR analysis through peak observation.

TABLE 5

Experiments between Caustic and Antifoulant additive in residue feedstock

| | NaOH, ppm | Antifoulant Additive-A, ppm | Temperature, ° C. | Reaction time, minutes | Conversion to Sodium naphthenate |
|---|---|---|---|---|---|
| 1 | 100 | 500 | 150 | 30 | 99% |
| 2 | 100 | 500 | 200 | 30 | 100% |
| 3 | 100 | 1000 | 150 | 30 | 100% |
| 4 | 100 | 1000 | 300 | 20 | 100% |

The experimental data provided in Table 5 demonstrates that Additive-A is capable of converting the sodium hydroxide in the residue feedstock to sodium naphthenate.

Example 3

A comparative study was carried out to compare the efficacy of the antifoulant additive of present invention vis-à-vis the high molecular weight tetracarboxylic acids (ARN acid disclosed in WO2010068261A2) as shown in the Table 6.

TABLE 6

Fouling experiment results

| Experiment No. | 1 | 2 | 3 | 4 |
|---|---|---|---|---|
| Feed | RCO | RCO | RCO | RCO |
| NAOH, ppm | — | 100 | 100 | 100 |
| Additive, ppm | — | — | 100 | 100 |
| Additive used | — | — | A (according to the present invention) | ARN Naphthenic acid (comparative example) |
| Coke Deposit, mg | 80 | 150 | 86 | 148 |

The results of Table 6 show that the additive of the present invention offers a superior performance compared to conventional antifoulant additives for preventing caustic induced fouling of thermal cracker furnace tubes.

We claim:

1. An antifoulant additive for preventing caustic induced furnace fouling, the additive comprising:

(a) naphthenic acid;

(b) petroleum sulphonate;

(c) phosphate ester; and (d) gasoil, wherein the naphthenic acid has a molecular weight in a range of 160 to 350 g/gmol and carbon number in a range of 8 to 25.

2. The additive as claimed in claim 1, wherein carbon atoms of the naphthenic acid ranges from 8 to 25.

3. The additive as claimed in claim 1, wherein the naphthenic acid is 3-Methyl-1-cyclohexanecarboxylic acid.

4. The additive as claimed in claim 1, wherein the petroleum sulphonate is calcium petroleum sulphonate having TBN in a range of 30 to 100.

5. The additive as claimed in claim 1, wherein the phosphate ester is a trialkyl or triaryl phosphate.

6. The additive as claimed in claim 1, wherein the gasoil is a light coker gasoil or a heavy coker gasoil stream boiling in a range of 140-540° C.

7. The additive as claimed in claim 1, wherein the naphthenic acid is present in a range of 50 to 95% by weight of the additive.

8. The additive as claimed in claim 1, wherein the petroleum sulphonate is present in a range of 0.1 to 20% by weight of the additive.

9. The additive as claimed in claim 1, wherein the phosphate ester is present in a range of 0.2 to 15% by weight of the additive.

10. The additive as claimed in claim 1, wherein the gasoil is present in a range of 1 to 30% by weight of the additive.

11. A process for preventing caustic induced furnace fouling, the process comprising adding the antifoulant additive claimed in claim 1, to a thermal cracker unit processing residue feedstock having a CCR in a range of 3 to 32 wt %.

12. The process as claimed in claim 11, wherein the additive is injected in a feed surge drum, a fractionator bottom section,or a furnace charge pump outlet of the thermal cracker unit.

13. The additive as claimed in claim 11, wherein the additive is injected at a rate of 1 to 1000 ppm in the feedstock to the thermal cracking unit.

14. A process for preparation of an antifoulant additive for preventing caustic induced furnace fouling, the process comprising:

a) adding naphthenic acid in a continuous stirred tank reactor at a temperature in a range of 30-50° C.;

b) adding petroleum sulphonate and phosphate ester to the reactor of step a) while stirring to obtain a mixture;

c) adding a gasoil stream to the mixture of step b) and stirring for 20 minutes; and d) cooling the above mixture to room temperature to obtain the antifoulant additive.

15. The process as claimed in claim 14, wherein the naphthenic acid is added to the reactor at a temperature of 40° C.

* * * * *